US006909860B2

(12) United States Patent
Serizawa et al.

(10) Patent No.: US 6,909,860 B2
(45) Date of Patent: Jun. 21, 2005

(54) IMAGE FORMING APPARATUS HAVING A GAP BETWEEN TONER-SUPPLYING AND DEVELOPING ROLLERS

(75) Inventors: Takashi Serizawa, Tokyo (JP); Hiroaki Sato, Tokyo (JP)

(73) Assignee: Oki Data Corp., Tokyo (JP)

( * ) Notice: Subject to any disclaimer, the term of this patent is extended or adjusted under 35 U.S.C. 154(b) by 0 days.

(21) Appl. No.: 10/699,682

(22) Filed: Nov. 4, 2003

(65) Prior Publication Data

US 2004/0091278 A1 May 13, 2004

(30) Foreign Application Priority Data

Nov. 6, 2002 (JP) ..... 2002-322115

(51) Int. Cl.[7] ..... G03G 15/08
(52) U.S. Cl. ..... 399/55; 399/281
(58) Field of Search ..... 399/55, 53, 252, 399/272, 274, 281, 284

(56) References Cited

U.S. PATENT DOCUMENTS 4,786,936 A * 11/1988 Ikegawa et al. ..... 399/272
4,885,223 A * 12/1989 Enoki et al. ..... 430/122
2003/0202811 A1 * 10/2003 Kamimura et al. ..... 399/53

FOREIGN PATENT DOCUMENTS

JP 2001-242701 9/2001

* cited by examiner

*Primary Examiner*—Quana Grainger
(74) *Attorney, Agent, or Firm*—Rabin & Berdo, P.C.

(57) ABSTRACT

An image forming apparatus includes an image bearing drum, a developing roller, a toner-supplying roller, and a controller. The developing roller deposits toner to an electrostatic latent image formed on the image bearing drum. The toner-supplying roller is spaced a distance in the range of 0.05 to 1.0 mm from the developing roller and supplies toner to the developing roller. The controller applies a first voltage to the developing roller and a second voltage to the toner-supplying roller. The difference between the first voltage and the second voltage is greater than 130 volts and lower than a voltage above which electrical discharge occurs across the developing member and the toner-supplying roller. The toner-supplying roller has a surface with ridges and valleys formed therein, which extend in a longitudinal direction of the toner-supplying roller. The ridges have a height in the range of 10 to 1000 $\mu$m.

20 Claims, 4 Drawing Sheets

IMAGE FORMING APPARATUS HAVING A GAP BETWEEN TONER-SUPPLYING AND DEVELOPING ROLLERS

BACKGROUND OF THE INVENTION

1. Field of the Invention

The present invention relates to an image forming apparatus.

2. Description of the Related Art

Conventional electrophotographic image forming apparatus such as printers, copying machines, and facsimile machines employ electrophotographic processes. A charging roller applies a high voltage to a photoconductive drum to uniformly charge the surface of the photoconductive drum. An exposing unit illuminates the charged surface of the photoconductive drum to form an electrostatic latent image on the photoconductive drum. Then, a developing unit develops the electrostatic latent image into a toner image. The toner image is then transferred onto a print medium, e.g., print paper.

The developing unit can be of non-magnetic one component developing method. This type of developing unit uses a non-magnetic toner. A thin layer of toner is formed on the developing roller that rotates in contact with or in non-contact with a photoconductive drum. The toner on the developing roller is attracted to an electrostatic latent image formed on the photoconductive drum, thereby forming a visible image or toner image on the photoconductive drum.

In such a developing unit, the toner is charged by the use of the friction between the toner particles, the friction between the toner particles and the developing roller, and the friction between toner particles and the developing blade.

With a developing unit in which a developing roller rotates in contact with a photoconductive drum, in order to form a thin layer of toner on the developing roller, the toner-supplying roller rotates in the same direction as the developing roller. The toner is first applied to the toner-supplying roller, which in turn deposits on the developing roller.

FIG. 7 illustrates a conventional image forming apparatus.

Referring to FIG. 7, reference 10 denotes a casing of a developing unit. A photoconductive drum 11 rotates in a direction shown by arrow A. A charging roller 12 rotates in a direction shown by arrow B to uniformly charge the photoconductive drum 11. An LED head 13 illustrates the charged surface of the photoconductive drum 11, thereby dissipating the charges on the photoconductive drum in accordance with an image to be printed. The areas in which the charges are dissipated have a potential of substantially 0 volts.

A toner cartridge 15 is removably attached to the case 10 of the developing unit. A developing roller 17 rotates in contact with the photoconductive drum in a direction shown by arrow C. A toner-supplying roller 16 rotates in contact with the developing roller 17 in a direction shown by arrow D. The toner falls from the toner cartridge 15 into the case 10 of the developing unit, is then supplied by the toner-supplying roller 16 to the developing roller 17, and is finally formed by the developing blade 14 into a thin layer on the developing roller 17.

The toner supplied to the developing roller 17 is deposited to the electrostatic latent image, thereby developing the electrostatic latent image into a toner image.

The toner image on the photoconductive drum 11 is transferred onto recording paper 19 by a transfer roller 18 that rotates in a direction shown by arrow E. After transferring, a cleaning blade scrapes residual toner off the photoconductive drum 11, thereby collecting the residual toner into a waste toner reservoir 15*a* provided in the toner cartridge 15. An agitator 21 agitates the toner fallen from the toner cartridge 15 into the case 10 of the developing unit, and supplies the toner to the toner-supplying roller 16.

FIG. 8 is a schematic view of a pertinent portion of the conventional image forming apparatus of FIG. 7.

A description will be given of the toner-supplying roller 16, developing roller 17, and developing blade 14.

Referring to FIG. 8, the toner-supplying roller 16 is surface-treated so that the surface of the toner-supplying roller 16 has a plurality of cells. The toner-supplying roller 16 is in contact with the developing roller 17, made of a rubber material, under a predetermined pressure (Japanese Patent Laid-Open No. 2001-242701).

The photoconductive drum 11 rotates at a circumferential speed of 150 mm/s in a direction shown by arrow. The developing roller 17 rotates at a circumferential speed of 192 mm/s in the C direction. The toner-supplying roller 16 rotates at a circumferential speed of 99 mm/s in the D direction.

A metal developing blade 14 has a thickness of 0.08 mm. The tip portion of the developing blade 14 is pressed against the developing roller 17. A power supply E1 applies a voltage of −330 volts to the toner-supplying roller 16. A power supply E2 applies a voltage of −200 volts to the developing roller 17. As the toner-supplying roller 16 rotates, the toner deposited on the toner-supplying roller 16 moves into frictional contact between the toner-supplying roller 16 and the developing roller 17, so that the toner is negatively charged and supplied to the developing roller 17.

The developing blade 14 forms a layer of toner having a uniform thickness on the developing roller 14. Then, the toner on the developing roller 17 is deposited on areas on the photoconductive drum 11 in which the electrostatic latent image is formed, thereby developing the electrostatic latent image with the toner into a toner image.

With the conventional developing unit of FIG. 7, the toner-supplying roller 16 is in pressure contact with the developing roller 17. These two rollers 16 and 17 rotate in the same direction. Therefore, a large torque load is exerted on the toner-supplying roller 16. This also exerts a large torque load on the developing roller 17. Moreover, because the toner-supplying roller 16 is made of sponge, the toner-supplying roller 16 wears easily, and therefore the electrical properties of the toner-supplying roller 16 deteriorate accordingly.

When the toner-supplying roller 16 and developing roller 17 rotate, the frictional force developed between these two rollers causes the toner to wear and agglomerate, resulting in deteriorated electrical properties of the toner.

As a result, the conventional image forming apparatus fails to form an image with high contrast.

SUMMARY OF THE INVENTION

The present invention was made in view of the aforementioned drawbacks of the conventional image forming apparatus.

An object of the invention is to provide an image forming apparatus in which image quality is improved.

An image forming apparatus includes an image bearing body, a developing member, a developer-supplying member, and a controller. The developing member causes toner to adhere to an electrostatic latent image formed on the image bearing body to form the electrostatic latent image into a visible image. The developer-supplying member is spaced a predetermined distance from the developing member and supplying toner to the developing member. The controller applies a first voltage to the developing member and a second voltage to the developer-supplying member.

The predetermined distance is in the range of 0.05 to 1.0 mm.

The developing member and the developer-supplying member rotate in a same direction.

The absolute value of a difference between the first voltage and the second voltage is greater than 130 volts and lower than a voltage above which electrical discharge occurs across the developing member and said developer-supplying member.

The second voltage has an absolute value of voltage in the range of 330 to 600 volts.

The developing member and said developer-supplying member rotate in a same direction.

The developer has a degree of cohesion equal to or lower than 25%.

Another image forming apparatus includes an image bearing body, a developing member, and a developer-supplying member. The developing member causes toner to adhere to an electrostatic latent image formed on the image bearing body to form the electrostatic latent image into a visible image. The developer-supplying member is spaced a predetermined distance from the developing member and supplying toner to the developing member. The developer-supplying member spaced a predetermined distance from said developing member and supplying the developer to said developing member, the developer-supplying member having a surface with ridges and valleys formed therein.

The developer-supplying member is made of an electrically conductive material.

The electrically conductive material is a metal.

The developer-supplying member is made of a mixture of a resin and an electrically conductive material.

The ridges and valleys extend in a direction parallel to a longitudinal axis of said developer-supplying member.

The distance between the ridges and the valleys is in the range of 10 to 1000 $\mu$m and ridges are formed at a pitch in the range of 10 to 1500 $\mu$m.

The developer-supplying member has a surface with a straight knurl.

The developer-supplying member has a surface with a diamond knurl.

The image forming apparatus according to claim 8, wherein said developer has a degree of cohesion equal to or lower than 25%.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

{Construction}

Figure 1:
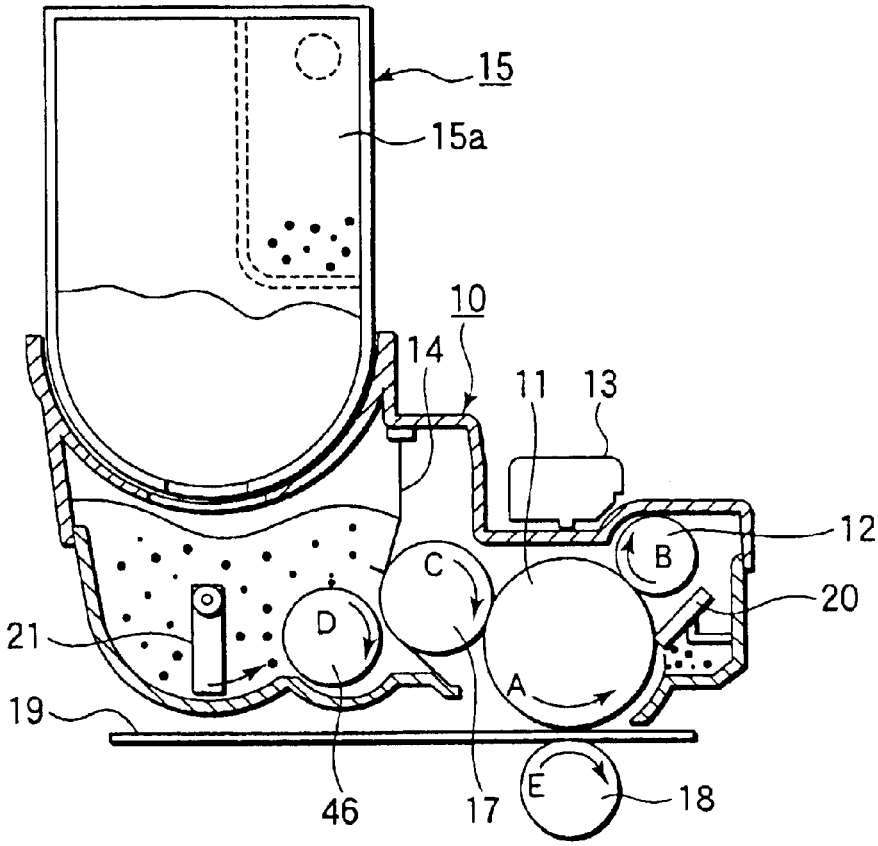
FIG. 1 illustrates a general configuration of an image forming apparatus according to a first embodiment of the invention.

FIG. 1 illustrates a general configuration of an image forming apparatus according to a first embodiment of the invention.

Referring to FIG. 1, reference 10 denotes a casing of a developing unit. A photoconductive drum 11 rotates in a direction shown by arrow A. A charging roller 12 rotates in a direction shown by arrow B to uniformly charge the photoconductive drum 11. An LED head 13 illuminates the charged surface of the photoconductive drum 11, thereby dissipating the charges on the photoconductive drum in accordance with an image to be printed. The areas on the photoconductive drum in which the charges are dissipated have a potential of substantially 0 volts.

A toner cartridge 15 is removably attached to the casing 10 of the developing unit. A developing roller 17 rotates in contact with the photoconductive drum 11 in a direction shown by arrow C. A toner-supplying roller 46 rotates in contact with the developing roller 17 in a direction shown by arrow D. The toner falls from the toner cartridge 15 into the casing 10 of the developing unit, is then supplied from the toner-supplying roller 46 to the developing roller 17, and is finally formed by the developing blade 14 into a thin layer on the developing roller 17.

The toner supplied to the developing roller 17 is deposited to the electrostatic latent image to form a toner image.

The toner image on the photoconductive drum 11 is transferred onto recording paper 19 by a transfer roller 18 that rotates in a direction shown by arrow E. After transferring, a cleaning blade 20 scrapes residual toner off the photoconductive drum 11, thereby collecting the residual toner into a waste toner reservoir 15*a* provided in the toner cartridge 15. An agitator 21 agitates the toner fallen from the toner cartridge 15 into the casing 10 of the developing unit, and supplies the toner to the toner-supplying roller 46.

A description will be given of the toner-supplying roller 46, developing roller 17, and developing blade 14.

Figure 2:
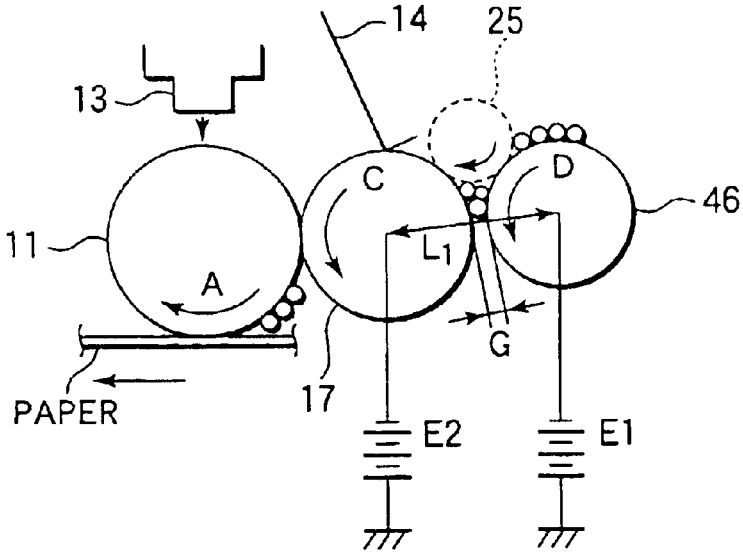
FIG. 2 is a schematic view of a pertinent portion of an image forming apparatus according to the present invention.

FIG. 2 is a schematic view of a pertinent portion of an image forming apparatus according to the present invention.

Referring to FIG. 2, the toner-supplying roller 46 has been surface-treated so that the surface of the toner-supplying roller 46 has a plurality of cells formed therein. The toner-supplying roller 46 and the developing roller 17 are spaced apart by a predetermined distance. The developing roller 17 is made of a rubber material and is in pressure contact with the photoconductive drum The photoconductive drum 11 rotates at a circumferential speed of 150 mm/s in the A direction. The developing roller 17 rotates at a circumferential speed of 192 mm/s in the C direction. The toner-supplying roller 16 rotates at a circumferential speed of 99 mm/s in the D direction.

A metal developing blade 14 has a thickness 0.08 mm. The tip portion of the developing blade 14 is pressed against the developing roller 17 under pressure. A power supply E1 applies a voltage of −330 volts to the toner-supplying roller 46. A power supply E2 applies a voltage of −200 volts to the developing roller 17. As the toner-supplying roller 46 rotates, the toner deposited on the toner-supplying roller 46 moves into frictional contact between the toner-supplying roller 46 and the developing roller 17, so that the toner is negatively charged and supplied to the developing roller 17.

The developing blade 14 forms a layer of toner on the developing roller 14, the layer having a uniform thickness. Then, the toner on the developing roller 17 is deposited on areas of the photoconductive drum in which the electrostatic latent image is formed, thereby developing the electrostatic latent image with the toner into a toner image.

By setting the distance between the circumferential surfaces of the toner-supplying roller 46 and the developing roller 17 to a value in the range of 0.05 to 1 mm, the toner can be supplied efficiently from the toner-supplying roller 46 to the developing roller 17. The distances larger than 1 mm do not allow the toner to be supplied efficiently, resulting in deteriorated image quality. When a shaft-to-shaft distance L1 between the developing roller 17 and the toner-supplying roller 46 is 8.14 mm, the diameter D of the toner-supplying roller 46 is preferably in the range of 15.94 to 14.04 mm.

Because the toner-supplying roller 46 is not in contact with the developing roller 17, the ability of the toner-supplying roller 46 to supply toner decreases if the toner-supplying bias is a conventional voltage of −330 volts. Thus, a sufficient amount of toner cannot be supplied to the developing roller 17, so that blurring occurs to deteriorate image quality.

Therefore, a toner-supplying bias higher than the conventional bias is applied to the toner-supplying roller 46 to create a potential difference greater than 130 volts between the developing bias and the toner supplying bias.

Because the toner-supplying roller 46 and the developing roller 17 are not in contact with each other, the toner between these rollers 46 and 17 cannot be charged triboelectrically. For this reason, a toner having low cohesion (i.e., high fluidity) is used. The cohesion of toner can be determined as follows: A three-stage sieve is built by stacking three sieves: an upper sieve having a mesh size of 150 $\mu$m, a middle sieve having a mesh size of 75 $\mu$m, and a lower sieve having a mesh size of 40 $\mu$m. Four grams of toner is placed on the upper sieve and the three-stage sieve is subjected to vibration. By the use of Powder Tester (available from Hosokawa Micron), the cohesion E of the toner can be calculated by $$E=\{(1/T)\{W_1+W_2(3/5)+W_3(1/5)\}\times 100\%$$

where T is a total amount of toner initially placed on the upper sieve (4 grams in this case) , $W_1$ is a weight of toner particles remaining on the upper sieve, $W_2$ is a weight of toner remaining on the middle sieve, and $W_3$ is a weight of toner remaining on the lower sieve. The Powder Tester was set to calibration "5" and subjected to vibration for 30 seconds. A toner having low cohesion has high fluidity and therefore there is less chance of toner agglomerating. Thus, a large number of toner particles can escape through the meshes of the respective sieves.

Figure 7:
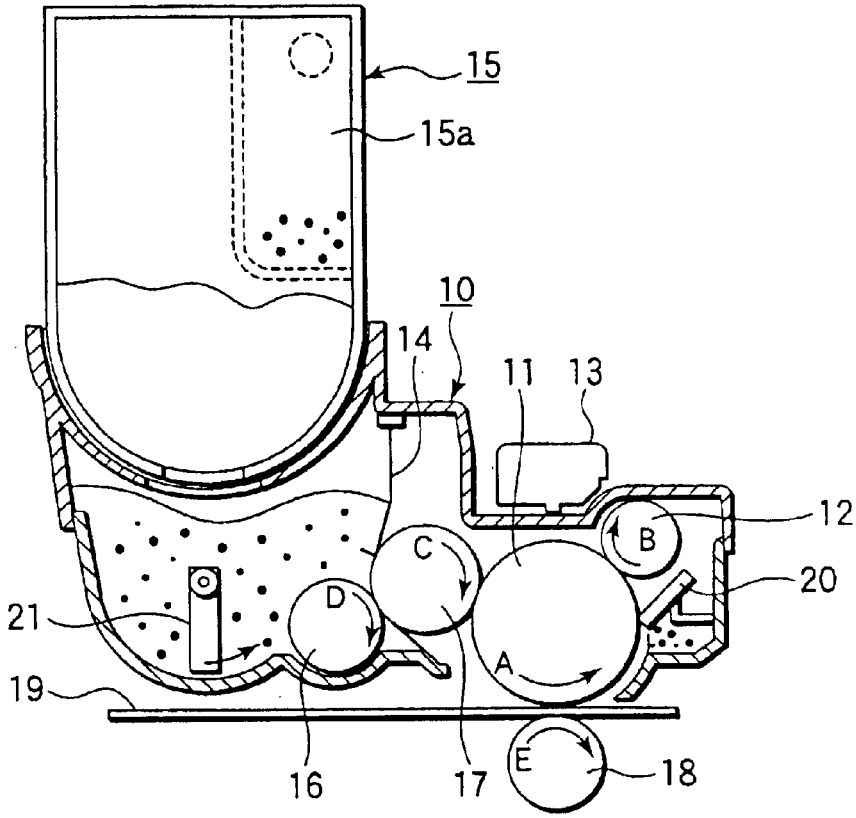
FIG.7 CONVENTIONAL ART
FIG. 7 illustrates a conventional image forming apparatus.
Figure 8:
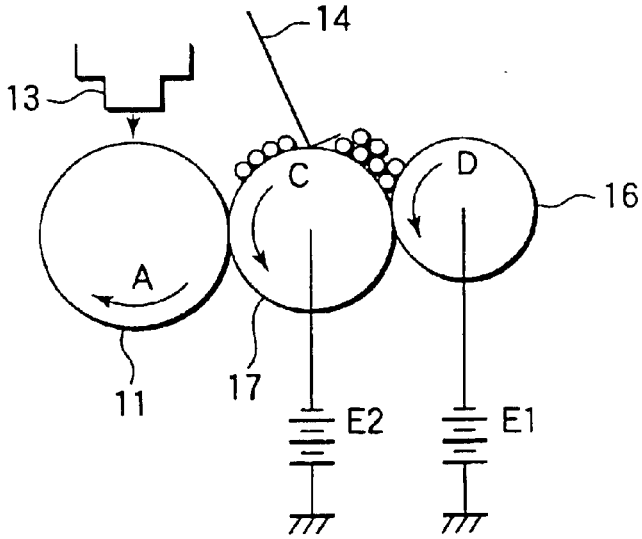
FIG.8 CONVENTIONAL ART
FIG. 8 is a schematic view of a pertinent portion of the conventional image forming apparatus of FIG. 7.

For the developing unit where the developing roller 17 is not in contact with the toner-supplying toner 46, the toner cannot be charged sufficiently and blurring occurs in printed images unless the toner has cohesion of less than 25%. Because the developing roller 17 is not in contact with the toner-supplying roller 46, the toner-supplying roller 46 rotates at a speed 1.5 times that of the conventional toner-supplying roller 16 (FIG. 7) so as to improve the ability of the roller 46 to supply the toner. For this purpose, a first gear, not shown, attached to an end of the developing roller 17, a second gear, not shown, attached to an end of the toner-supplying roller 46, and an idle gear 25 in mesh with the first and second gears are designed to have a predetermined number of teeth, respectively.

With the aforementioned image forming apparatus, the toner having a potential of 0 volts falls from the toner cartridge 15 (FIG. 1) into the casing of the developing unit. The toner is directed to the toner-supplying roller 46, which in turn delivers the toner at a speed of 1.5 times that of the conventional apparatus. The difference in potential between the toner-supplying roller 46 and the developing roller 17 is in the range of 130 to 600 volts. This potential difference allows the toner to be supplied from the toner-supplying roller 46 to the developing roller 17 despite the gaps G between these two rollers 46 and 17. The toner supplied to the developing roller 17 is negatively charged before being deposited to the electrostatic latent image formed on the photoconductive drum 11.

{Operation}

Table 1 lists the results of experiment conducted for different gaps G in the range of 0.1 to 1.4 mm.

TABLE 1

| gap G (mm) | Blurring | supply of toner to developing roller |
|---|---|---|
| 0.01 | not occurred | |
| 0.05 | not occurred | |
| 0.1 | not occurred | |
| 0.2 | not occurred | |
| 0.4 | not occurred | |
| 0.6 | not occurred | |
| 0.8 | not occurred | |
| 1.0 | not occurred | |
| 1.2. | occurred | insufficient |
| 1.4 | occurred | insufficient |

The experiment was conducted with the following conditions. The developing bias was −200 volts and the toner-supplying bias was −470 volts. The developing roller 17 has an electrically conductive shaft on which a layer of rubber (urethane rubber) is formed. The material of developing blade 14 is SUS304B-TA, and has a thickness of 0.08 mm and a rounded tip having a radius of 0.275 mm. The tip portion is bent and placed in contact with the developing roller 17.

By using a pattern having lateral stripes, continuous printing of 20000 pages was performed at a duty cycle of 5%. Subsequently, printing was performed for a solid black (i.e., duty cycle of 100%) pattern, a 2×2 pattern, (i.e., duty cycle of 50%) , and a plurality of ruled lines of single dots, to determine whether blurring occurs in printed images.

For the solid black pattern and the 2×2 pattern, it is determined that blurring has occurred if white lines are observed in a printed image. For the plural 1-dot ruled lines, it is determined that blurring has occurred if the absence of dot is observed in plural 1-dot ruled lines. It is determined that blurring has not occurred if dots are absent only in one dotted line.

Experiment revealed that gaps G larger than 1.0 mm cause blurring and reduce the supply of toner to the developing roller 17 while gaps G equal to or smaller than 1.0 mm do not cause blurring. Thus, gap G should be equal to or smaller than 1.0 mm. Considering manufacturing variations and assembly accuracy of the toner-supplying roller 46, it can be said that gaps G larger than 0.05 mm do not cause contact between the toner-supplying roller 46 and the developing roller 17 and gaps G smaller than 0.05 mm may cause contact. If the toner-supplying roller 46 is made with high accuracy, a gap G of 0.01 mm still prevents the toner-supplying roller 46 from contacting the developing roller 17 but the cost of the image forming apparatus will increase correspondingly.

The gap G is preferably in the range of $0.05 \leqq G \leqq 1.0$ mm.

The toner bias will be described. Table 2 lists the results of experiment conducted for different toner biases in the range of −310 to −850 volts.

TABLE 2

| Gap (mm) | Toner supplying bias (V) | Blurring |
|---|---|---|
| 0.05 | −310 | occurred |
| | −320 | occurred |
| | −330 | not occurred |
| | −340 | not occurred |
| | −350 | not occurred |
| | −400 | not occurred |
| | −450 | not occurred |
| | −500 | not occurred |
| | −600 | not occurred |
| | −650 | not occurred |
| | −700 | not occurred |
| | −750 | not occurred |
| | −800 | not occurred |
| | −850 | Not occurred (discharge occurred across toner-supplying roller and developing roller) |
| 1.0 | −310 | occurred |
| | −320 | occurred |
| | −330 | not occurred |
| | −340 | not occurred |
| | −350 | not occurred |
| | −400 | not occurred |
| | −450 | not occurred |
| | −500 | not occurred |
| | −600 | not occurred |
| | −650 | not occurred |
| | −700 | not occurred |
| | −750 | not occurred |
| | −800 | not occurred |
| | −850 | not occurred |

The experiment was conducted with the previously mentioned conditions. The gap G was selected in two values, 0.05 mm and 1.0 mm: a minimum value and a maximum value of the aforementioned range.

No blurring was observed for gaps of 0.05 mm and 1.0 mm, provided that the toner-supplying bias was higher than −330 volts (i.e., the absolute value of toner-supplying bias is greater than 330) and the potential difference between the toner-supplying bias and the developing bias was larger than 130 volts. When the toner-supplying bias was lower than −330 volts (i.e., the absolute value of toner-supplying bias is smaller than 330) volts and the potential difference in volts was less than an absolute value of 130, blurring was observed.

When the gap G was 0.05 mm, if the toner-supplying bias is higher than −850 volts (i.e., the absolute value of toner-supplying bias is greater than 850) and the potential difference was higher than 650 volts above which a discharge can occur, then a discharge occurred actually.

Therefore, the toner-supplying bias is preferably between −330 volts and −600 volts, and the difference in potential between the toner-supplying roller 46 and the developing roller 17 should be such that a breakdown voltage exceeds the difference by at least 130 volts (in absolute value) . Breakdown voltage is a voltage above which an electrical discharge occurs. That is, the absolute value of the potential difference is larger than a sum of 130 and the absolute value of breakdown voltage. The cohesion of toner will be described. Table 3 lists the results of experiment conducted for different toners in degree of cohesion ranging from 15 to 35%.

TABLE 3

| Gap (mm) | Cohesion (%) | Blurring |
|---|---|---|
| 0.05 | 15 | not occurred |
| | 20 | not occurred |
| | 25 | not occurred |
| | 30 | occurred |
| | 35 | occurred |
| 1.0 | 15 | not occurred |
| | 20 | not occurred |
| | 25 | not occurred |
| | 30 | occurred |
| | 35 | occurred |

The experiment was conducted with the previously mentioned conditions. Two values of gap G were selected, 0.05 mm and 1.0 mm: a minimum value and a maximum value of the aforementioned optimum range.

Experiment revealed that gaps of 0.05 mm and 1.0 mm did not cause blurring if the toner has a degree of cohesion less than 25%. This is because the lower the cohesion, the higher the fluidity, so that a sufficient amount of toner is supplied from the toner-supplying roller 46 to the developing roller 17.

As mentioned above, the toner-supplying roller 46 and developing roller 17 are not in contact with each other. Thus, even when the rollers 46 and 17 are rotated in the same direction, the toner-supplying roller 46 is free from torque load and the toner-supplying roller 46 does not exert a significant torque load on the photoconductive drum 11. The average torque load on the photoconductive drum 11 was in the range of 4 to 4.5 kg in the conventional art but in the range of 1.8 to 2 kg in the embodiment. Consequently, the embodiment reduces the load exerted on a drive motor, not shown, that drives the photoconductive drum 11 in rotation. Thus, fluctuation in the rotation of the photoconductive drum 11 can be prevented.

The toner-supplying roller 46 is not subject to wear because the toner-supplying roller 46 is not in contact engagement with the developing roller 17. This prevents the electrical properties of the toner-supplying roller 46 from being deteriorated. Moreover, even if the toner-supplying roller 46 and developing roller 17 are rotated in the same direction, a large force is not exerted on the toner between the two rollers 46 and 17. Thus, wear and cohesion of toner can be prevented so that the electrical properties of toner are prevented from being deteriorated.

As a result, an original image having high contrast can be reproduced, thereby improving image quality.

Second Embodiment

{Construction}

Figure 3:
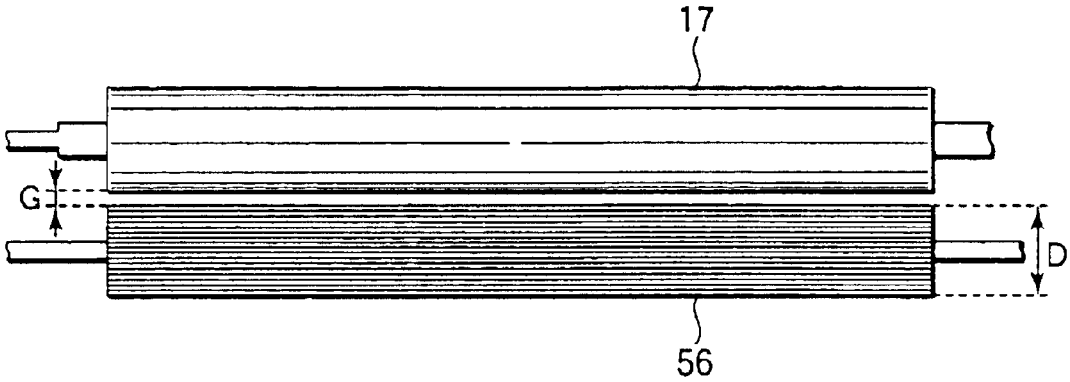
FIG. 3 illustrates the relation between the developing roller and toner-supplying roller according to a second embodiment.

FIG. 3 illustrates the relation between a developing roller and a toner-supplying roller according to a second embodiment.

Figure 4:
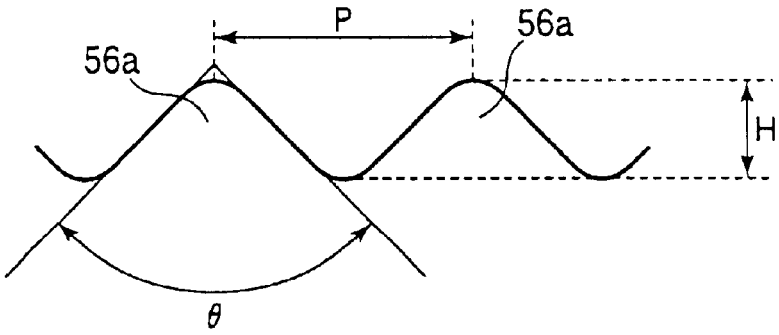
FIG. 4 is a fragmentary view, illustrating ridges and valleys formed in the surface of the toner-supplying roller according to the second embodiment.

FIG. 4 illustrates ridges and valleys formed in the surface of the toner-supplying roller according to the second embodiment.

Referring to FIG. 3, the toner-supplying roller 56 is not in contact engagement with developing roller 17. The toner-supplying roller 56 has the same rotational speed, diameter D, toner-supplying bias, and gap G as the toner-supplying roller 46 in the first embodiment.

The toner-supplying roller according to the second embodiment is made of an electrically conductive material (e.g., metal) having a surface with straight knurls, thereby ensuring as good an ability to supply toner as the toner-supplying roller 46 according to the first embodiment. In other words, there are provided projections 56 on the surface of the toner-supplying roller, the projections 56 extending in directions parallel to a longitudinal axis of the toner-supplying roller. The projection 56*a* has a height H in the range from 10 to 1000 μm, a pitch P in the range of 10 to 1500 μm m, an angle θ of about 90°, and a rounded top end having a radius in the range of 0.1 to 0.15 mm.

The projections 56*a* improve the ability of the toner-supplying roller 56 to supply toner to the developing roller 17. Just as in the first embodiment, experiment revealed that the toner having a degree of cohesion higher than 25% can cause blurring.

{Operation}

By using the aforementioned toner-supplying roller 56 with straight knurl, experiment was conducted for different heights H of projection in the range of 0 to 1200 μm. Table 4 lists the results of the experiment.

TABLE 4

| Height (μm) | Blurring | Supply of toner to developing roller |
|---|---|---|
| 0 | occurred | insufficient |
| 5 | occurred | insufficient |
| 10 | not occurred | |
| 100 | not occurred | |
| 200 | not occurred | |
| 400 | not occurred | |
| 600 | not occurred | |
| 800 | not occurred | |
| 1000 | not occurred | |
| 1100 | occurred | toner is clogged in recess |
| 1200 | occurred | toner is clogged in recess |

The conditions of the experiment are the same as for the first embodiment. The pitch P is changed in increments of 250 μm from 500 to 3000 μm.

When the experiment was conducted with the aforementioned conditions, toner particles slipped through the valleys between adjacent ridges if the height of the ridges is less than 5 μm. This causes insufficient delivery of toner to the developing roller 17, resulting in blurring in printed image. Heights greater than 1100 μm cause the toner to enter the valleys to be trapped therein. The toner agglomerates in the shallow valleys to make the valleys even shallower, thereby allowing the toner particles to slip through the valleys. This causes insufficient delivery of toner to the developing roller 17, resulting in blurring.

For this reason, the height of the ridges is preferably in the range of $10 \leqq \underline{H} \leqq 1000$ μm. The results were the same for pitches P in the range of 500 to 3000 μm.

By using the aforementioned toner-supplying roller with straight knurl, experiment was conducted for different heights of projection in the range of 0 to 1200 μm. Table 5 lists the results of the experiment.

TABLE 5

| Pitch (μm) | Blurring | Supply of toner to developing roller |
|---|---|---|
| 5 | occurred | toner is clogged in recess |
| 10 | not occurred | |
| 100 | not occurred | |
| 200 | not occurred | |
| 400 | not occurred | |
| 600 | not occurred | |
| 800 | not occurred | |
| 1000 | not occurred | |
| 1100 | not occurred | |
| 1200 | not occurred | |
| 1300 | not occurred | |
| 1400 | not occurred | |
| 1500 | not occurred | |
| 1600 | occurred | toner slips through wide recess |
| 1800 | occurred | toner slips through wide recess |
| 2000 | occurred | toner slips through wide recess |
| 2500 | occurred | toner slips through wide recess |
| 3000 | occurred | toner slips through wide recess |

The conditions of the experiment are the same as for the first embodiment. The experiment was conducted for different values of height H in increments of 250 μm from 0 to 1200 μm.

Pitches P smaller than 5 μm make the recesses too narrow so that toner particles are trapped therein. The narrow recesses cause the toner particles to agglomerate, making the recesses too shallow so that the toner particles slip through the valleys defined between the ridges. This causes insufficient delivery of toner to the developing roller 17, resulting in blurring in printed images.

Heights greater than 1600 μm make the recesses too wide so that the change in surface height is rather too gentle. This gentle change in surface height causes the toner to slip through the recesses, failing to deliver a sufficient amount of toner to the developing roller 17 and thus resulting in blurring.

As described above, the second embodiment prevents occurrence of blurring and improves image quality. The toner-supplying roller 56 made of metal is more effective in reducing the cost of an image forming apparatus than the toner-supplying roller 46 made of sponge (FIG. 1).

In the second embodiment, the toner-supplying roller 56 is made of a metal, but may be formed of a material in which a mold resin such as ABS, PC/PS is mixed with an electrically conductive material such as carbon and titanium oxide. The toner-supplying roller yet may be made of plastics materials and acrylic materials, in which case, the image forming apparatus can be reduced in cost and weight.

Third Embodiment

{Construction}

In the second embodiment, when a large number of pages is printed at a high duty cycle, a sufficient amount of toner may not be delivered from the toner-supplying roller 56 to the developing roller 17, in which case, print density may become low. The third embodiment can supply a sufficient amount of toner from the toner-supplying roller 56 to the developing roller 17 for proper print density even when the printing duty cycle is high.

Figure 5A:
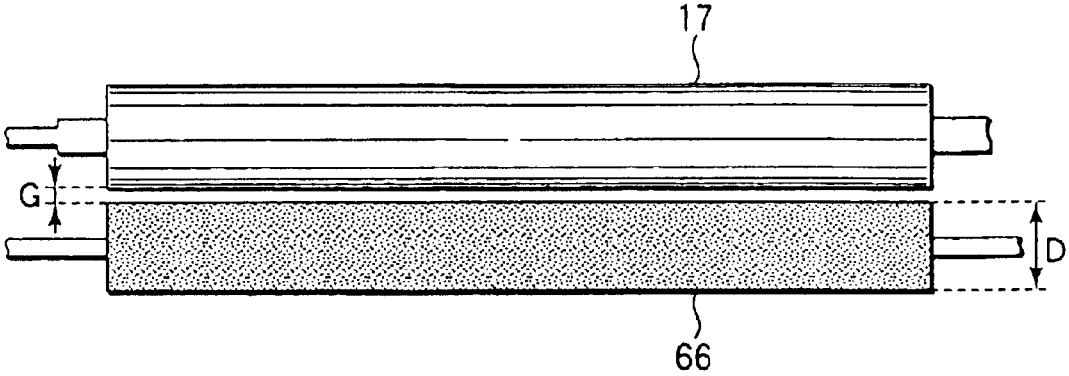
FIG. 5A illustrates the relation between a developing roller and a toner-supplying roller according to a third embodiment.

FIG. 5A illustrates the relation between a developing roller and a toner-supplying roller according to the third embodiment.

Figure 5B:
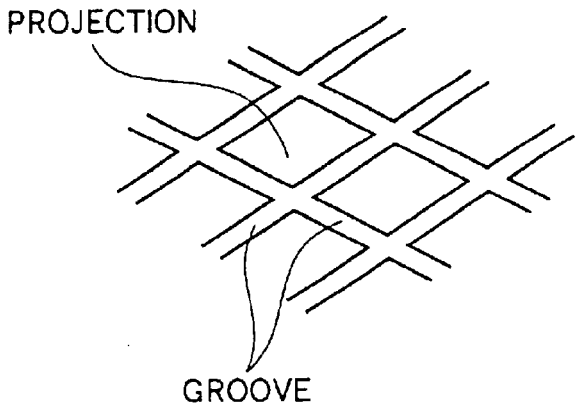
FIG. 5B is a fragmentary enlarged view of the toner-supplying roller of FIG. 5A.
Figure 5C:
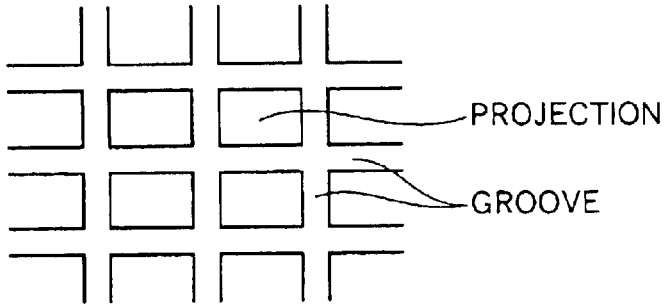
FIG. 5C is a fragmentary enlarged view of the toner-supplying roller of FIG. 5B;.

FIG. 5B is a fragmentary enlarged view of the toner-supplying roller of FIG. 5A;

FIG. 5C is a fragmentary enlarged view of a modification to the surface of the toner-supplying roller of FIG. 5B;

A toner-supplying roller 66 is made of an electrically conductive material, for example, metal, and is diamond-knurled. Alternatively, the diamond knurls shown in FIG. 5B may be replaced by substantially square knurls or rectangular knurls. FIG. 5C illustrates substantially rectangular projections aligned in matrix form. Just as in the second embodiment, the projection has a height H in the range from 10 to 1000 $\mu$m, a pitch P in the range of 10 to 1500 $\mu$m, an angle $\theta$ of about 90°, and a rounded end R having a radius in the range of 0.1 to 0.15 mm. The projections or lines of projections extend in a longitudinal direction thereof. The toner-supplying bias is the same as for the second embodiment. Experiment revealed that the toner having a degree of cohesion lower than 25% can cause blurring.

Because the surface of the toner-supplying roller 66 is diamond-knurled, the surface has a large area in contact with toner. This further improves the ability of the toner-supplying roller 66 to deliver the toner.

{Operation}

Tables 6 and 7 list the results of experiment conducted in the same way as the second embodiment.

TABLE 6

| Height ($\mu$m) | Blurring | Supply of toner to developing roller |
|---|---|---|
| 0 | occurred | insufficient |
| 5 | occurred | insufficient |
| 10 | not occurred | |
| 100 | not occurred | |
| 200 | not occurred | |
| 400 | not occurred | |
| 600 | not occurred | |
| 800 | not occurred | |
| 1000 | not occurred | |
| 1100 | occurred | toner is clogged in recess |
| 1200 | occurred | toner is clogged in recess |

TABLE 7

| Pitch ($\mu$m) | Blurring | Supply of toner to developing roller |
|---|---|---|
| 5 | occurred | toner is clogged in recess |

TABLE 7-continued

| Pitch ($\mu$m) | Blurring | Supply of toner to developing roller |
|---|---|---|
| 10 | not occurred | |
| 100 | not occurred | |
| 200 | not occurred | |
| 400 | not occurred | |
| 600 | not occurred | |
| 800 | not occurred | |
| 1000 | not occurred | |
| 1100 | not occurred | |
| 1200 | not occurred | |
| 1300 | not occurred | |
| 1400 | not occurred | |
| 1500 | not occurred | |
| 1600 | occurred | toner slips through wide recess |
| 1800 | occurred | toner slips through wide recess |
| 2000 | occurred | toner slips through wide recess |
| 2500 | occurred | toner slips through wide recess |
| 3000 | occurred | toner slips through wide recess |

Experiment reveals that the toner-supplying roller 66 having a surface with diamond knurl provides the same results as the toner-supplying roller 56 (FIG. 3) having a surface with straight knurl.

The height H of the projection of the toner-supplying roller 66 should be in the range of $10 \leqq \underline{H} \leqq 1000$ $\mu$m and the pitch should be in the range of $10 \leqq \underline{H} \leqq 1500$ $\mu$m.

Because the toner is agitated during printing, the larger the number of pages, the higher the cohesion of toner, so that the fluidity of toner deteriorates correspondingly.

Figure 6:
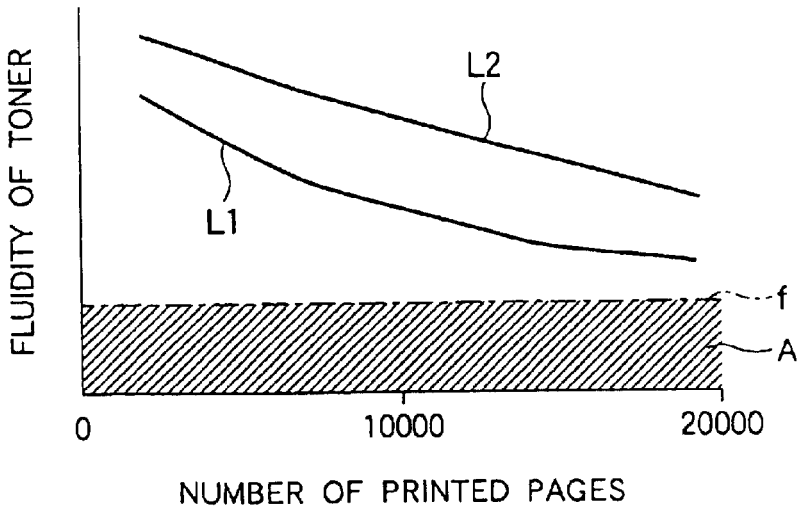
FIG. 6 illustrates the relation between the number of printed pages and the fluidity of toner according to the third embodiment.

FIG. 6 illustrates the relation between the number of printed pages and the fluidity of toner according to the third embodiment.

Referring to FIG. 6, fluidity less than f % causes blurring in printed image. Symbol "A "denotes a region in which blurring occurs. Line L1 shows the fluidity of toner when the toner-supplying roller 56 has straight knurls is used. Line L2 shows the fluidity of toner when the toner-supplying roller 66 with diamond knurls is used.

As is clear from FIG. 6, the fluidity of toner decreases with increasing number of printed pages. The toner fluidity is higher when the toner-supplying roller 66 diamond-knurled is used than when the toner-supplying roller 56 with straight knurls is used.

The print density in solid black printing can be improved by 5% by using the toner-supplying roller 66 instead of the toner-supplying roller 56.

As described above, the diamond-knurled surface of the toner-supplying roller 66*a* allows a sufficient amount of toner to be supplied from the toner-supplying roller 66 to the developing roller 17, preventing blurring in solid black printing as well as providing sufficient print density.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus comprising:

an image bearing body;

a developing member that causes non-magnetic developer to adhere to an electrostatic latent image formed on said image bearing body to form the electrostatic latent image into a visible image;

a developer-supplying member spaced a predetermined distance from said developing member and supplying the non-magnetic developer to said developing member;

a limiting member that is urged against said developing member to form a thin layer of non-magnetic developer on said developing member; and a voltage controller that applies a first voltage to said developing member and a second voltage to said developer-supplying member.

2. The image forming apparatus according to claim 1, wherein the predetermined distance is in the range of 0.05 to 1.0 mm.

3. The image forming apparatus according to claim 2, wherein said developing member and said developer-supplying member rotate in a same direction.

4. The image forming apparatus according to claim 1, wherein an absolute value of a difference between the first voltage and the second voltage is greater than 130 volts and lower than a voltage above which electrical discharge occurs across said developing member and said developer-supplying member.

5. The image forming apparatus according to claim 4, wherein the second voltage has an absolute value in the range of 330 to 600 volts.

6. The image forming apparatus according to claim 5, wherein said developing member and said developer-supplying member rotate in a same direction.

7. An image forming apparatus comprising:

an image bearing body;

a developing member that causes developer to adhere to an electrostatic latent image formed on said image bearing body to form the electrostatic latent image into a visible image;

a developer-supplying member spaced a predetermined distance from said developing member and supplying the developer to said developing member; and a voltage controller that applies a first voltage to said developing member and a second voltage to said developer-supplying member, wherein said developer has a degree of cohesion equal to or lower than 25%.

8. An image forming apparatus comprising:

an image bearing body;

a developing member that causes developer to adhere to an electrostatic latent image formed on said image bearing body to form the electrostatic latent image into a visible image;

a developer-supplying member spaced a predetermined distance from said developing member and supplying the developer to said developing member, said developer-supplying member having a surface with ridges and valleys formed therein, wherein said developer has a degree of cohesion equal to or lower than 25%.

9. The image forming apparatus according to claim 8, wherein said developer-supplying member is made of an electrically conductive material.

10. The image forming apparatus according to claim 9, wherein the electrically conductive material is a metal.

11. The image forming apparatus according to claim 9, wherein said developer-supplying member is made of a mixture of a resin and an electrically conductive material.

12. The image forming apparatus according to claim 8, wherein the ridges and valleys extend in a direction parallel to a longitudinal axis of said developer-supplying member.

13. The image forming apparatus according to claim 8, wherein a distance between the ridges and the valleys is in the range of 10 to 1000 $\mu$m and ridges are formed at a pitch in the range of 10 to 150 $\mu$m.

14. An image forming apparatus comprising:

an image bearing body;

a developing member that causes developer to adhere to an electrostatic latent image formed on said image bearing body to form the electrostatic latent image into a visible image;

a developer-supplying member spaced a predetermined distance from said developing member and supplying the developer to said developing member, said developer-supplying member having a surface with a straight knurl formed therein.

15. An image forming apparatus comprising:

an image bearing body;

a developing member that causes developer to adhere to an electrostatic latent image formed on said image bearing body to form the electrostatic latent image into a visible image;

a developer-supplying member spaced a predetermined distance from said developing member and supplying the developer to said developing member, said developer-supplying member having a surface with a diamond knurl formed therein.

16. The image forming apparatus according to claim 15, wherein said developer has a degree of cohesion equal to or lower than 25%.

17. The image forming apparatus according to claim 8, further comprising a controller that supplies a first voltage to said developing member and a second voltage to said developer-supplying member.

18. An image forming apparatus comprising:

an image bearing body;

a developing member that causes developer to adhere to an electrostatic latent image formed on said image bearing body to form the electrostatic latent image into a visible image;

a developer-supplying member spaced a predetermined distance from said developing member and supplying the developer to said developing member, said developer-supplying member having a surface with ridges and valleys formed therein; and a controller that supplies a first voltage to said developing member and a second voltage to said developer-supplying member, wherein an absolute value of a difference between the first voltage and the second voltage is greater than 130 volts and lower than a voltage above which electrical discharge occurs across said developing member and said developer-supplying member.

19. The image forming apparatus according to claim 18, wherein the second voltage has an absolute value of voltage in the range of 330 to 600 volts.

20. The image forming apparatus according to claim 8, wherein the predetermined distance is in the range of 0.05 to 1.0 mm.

* * * * *